United States Patent [19]

Liedberg

[11] 4,197,994

[45] Apr. 15, 1980

[54] SPRAYING DEVICE

[75] Inventor: Kurt H. Liedberg, Skara, Sweden

[73] Assignee: Atlas Copco Aktiebolag, Nacka, Sweden

[21] Appl. No.: 871,396

[22] Filed: Jan. 23, 1978

[30] Foreign Application Priority Data

Nov. 3, 1977 [SE] Sweden ..... 7712415

[51] Int. Cl.[2] ..... B05B 7/12

[52] U.S. Cl. ..... 239/61; 239/414; 239/527

[58] Field of Search ..... 239/407, 412–415, 239/416.2, 527, 61, 67–69; 222/153

[56] References Cited

U.S. PATENT DOCUMENTS

| | | | |
|---|---|---|---|
| 1,303,987 | 5/1919 | Sturcke | 239/527 X |
| 2,488,985 | 11/1949 | Peeps | 239/414 X |
| 2,959,358 | 11/1960 | Vork | 239/414 X |
| 3,118,569 | 1/1964 | Lieberg et al. | 222/133 |
| 3,322,351 | 5/1967 | Hackel | 239/412 X |
| 3,559,891 | 2/1971 | Liedberg et al. | 239/412 X |

*Primary Examiner*—Robert W. Saifer

*Attorney, Agent, or Firm*—Frishauf, Holtz, Goodman & Woodward

[57] ABSTRACT

A spraying device for applying a coating material such as anticorrosion oil to the internal surfaces of hollow bodies comprises a spray gun provided with a front piece which is inserted into the hollow body during operation of the device. Furthermore, the device comprises a pump for feeding the spray material to the gun and a control device for controlling the gun, the pump and the introduction of compressed gas into the front piece. This gas is introduced in order to further atomize the spray material ejected through an atomizing nozzle of the gun and in order to support the transport of the spray material through the front piece. The control device comprises means for controlling the rate of introduction of spray material into the gun. As a consequence, the degree of atomization of the spray material leaving the front piece is variable.

6 Claims, 1 Drawing Figure

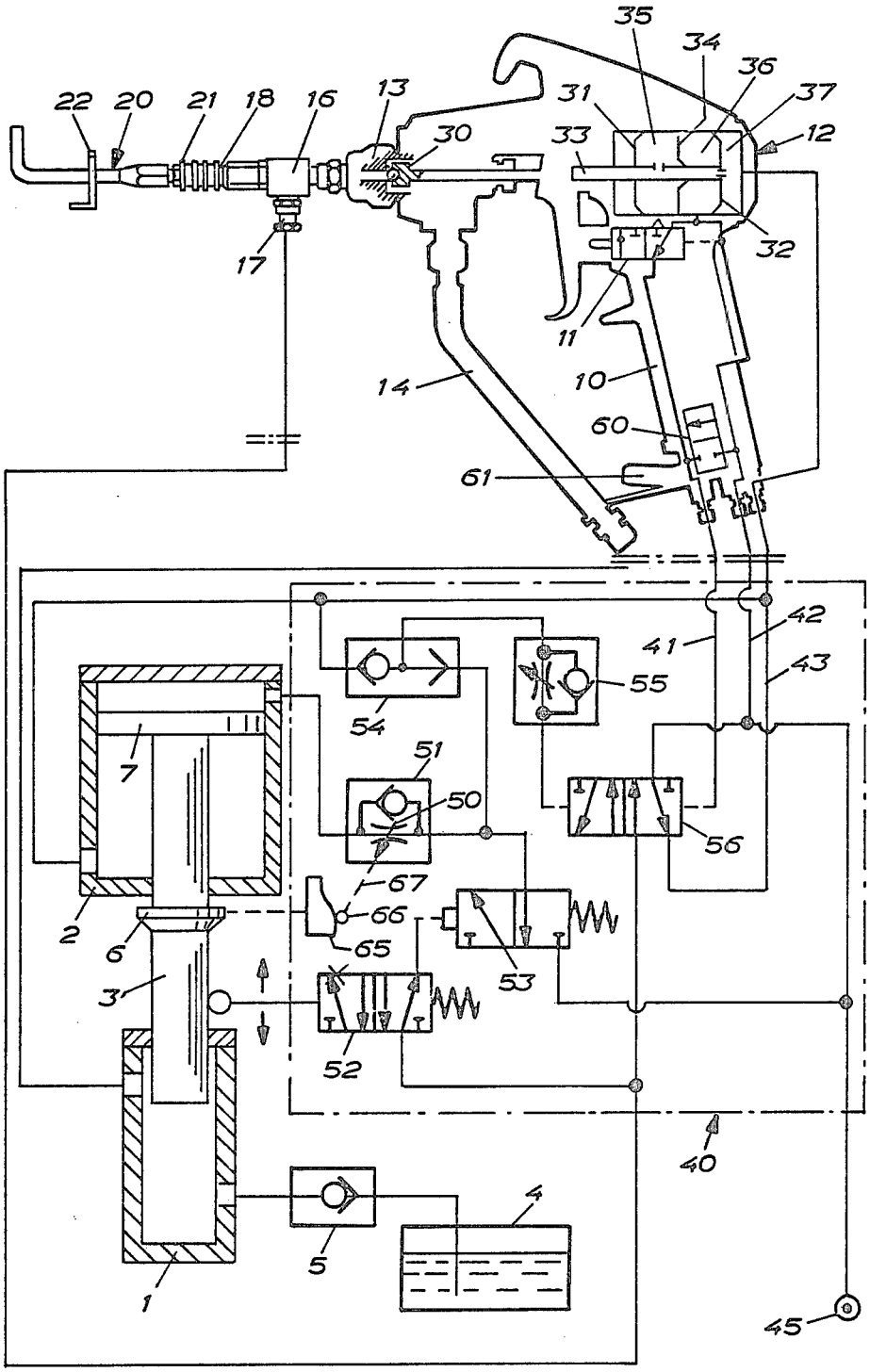
35
34
36
37
12
31
33
32
22
20
21
18
16
13
30
17
11
10
14
60
61
42
41
43
55
54
51
50
56
7
67
66
65
53
2
6
3
52
40
4
5
1
45

SPRAYING DEVICE

The present invention relates to a device for internal coating of hollow spray objects by means of spraying.

The purpose of the invention is to solve the problem of ensuring an effective coating of the walls of cavities which are completely closed with the exception of one or more injection holes.

Anticorrosion treatment of car bodies could be mentioned as an application example. There are a number of cavities of different size and form in car bodies. These cavities should be coated with anticorrosion oil. Since this treatment is carried out at an assembly line or similar place where the time of treatment must be kept down, it is important that a cavity can be treated from as few injection holes as possible.

According to the invention, as defined in the claims, this is possible by means of an adjustable degree of atomization of the spray material. This makes it possible to adjust the depth of penetration of the spray material into the cavity. A higher degree of atomization of the spray material means smaller droplets which primarily settle on the cavity walls relatively close to the injection hole. A lower degree of atomization means bigger droplets which settle relatively far from the injection hole.

With the invention as defined in the claims an effective surface treatment of cavities is ensured because the correct amount of spray material is injected with optimal space distribution.

BRIEF DESCRIPTION OF THE DRAWINGS

An embodiment of the invention is described below with reference to the accompanying drawing which schematically shows a spray gun with a feed pump for the spray material and a control device for controlling the gun and the pump.

DETAILED DESCRIPTION

The spray gun comprises a handle 10, a trigger valve 11 and a pneumatic servomotor 12 which is controlled by the trigger valve 11 for activating a spray material valve 30. Compressed air is supplied to the trigger valve 11 and the servomotor 12 via connections on the handle 10. The gun is provided with an atomizing nozzle 13 to which the spray material is supplied under pressure via a conduit 14 and the spray material valve 30.

Since the design and operation of the servomotor 12 has been described in detail in U.S. Pat. No. 3,559,891 a brief description only will be presented below in connection with the control device.

The downstream side of the atomizing nozzle of the gun is provided with a connection block 16 which is provided with a quick connection means 18 and an inlet nipple 17 for a compressed air conduit. A front piece 20 is connected to the connection block 16 by means of a quick connection means 21.

The front piece 20 comprises a tube having such a form and being provided with a positioning collar 22 having such a form and position that the front piece is given its correct spray position and direction in the cavity when the positioning collar 22 is applied against the outer surface of the spray object. A special front piece is, therefore, required for each type of spray object. For certain spray objects it is suitable to make the front piece such that a part between the positioning collar 22 and the connection means 21 is flexible.

The spray gun shown is a so-called high pressure gun in which the spray material is atomized during passage through the atomizing nozzle 13 without assistance of compressed air. In order to further atomize the spray material and in order to support its transport through the front piece 20, compressed air, or another gas under pressure, is supplied through the inlet nipple 17.

The servomotor 12 comprises two pistons 31, 32 mounted on a common piston rod 33. A cylindrical bore in the housing of the gun defines together with a stationary intermediate wall 34 and the pistons 31, 32 three separate chambers 35, 36, 37. The chambers 35 and 37 communicate with each other through a passage in the piston rod 33. When all three chambers are pressurized the spray material valve 30 is closed. It is opened when chambers 35 and 37 are vented.

In order to supply spray material to the gun the device shown is provided with a piston pump 1 whose piston rod 3 is connected with the piston 7 of an air cylinder 2. The piston 7 is driven by pressurizing one side thereof at the same time as its other side is vented. During the return stroke of the piston rod 3 spray material is sucked from the container 4 via the check valve 5 into the pump housing 1. During the forward stroke of the pump a volume of spray material, determined by the length of the pump stroke, is delivered under high pressure via the conduit 14 and the spray material valve 30 to the front piece 20 for injection into the cavity to be coated. The pump stroke is interrupted when the flange 6 on the piston rod 3 shifts the valve 52. In order to change the length of the pump stroke, and thus the volume of delivered spray material, the valve 52 may be movable along the piston rod 3 or the flange 6 be movable along the piston rod 3.

In order to ensure that the correct amount of spray material always is obtained the device is designed such that the spraying is completely controlled by the control system 40 independent of how long the trigger valve 11 is activated.

The control device 40 comprises a number of valves of which the valve 52 is activated mechanically by the flange 6 against spring action. Valve 52 will at rest take the position shown in the drawing. Valve 53 is pneumtically actuated against spring action and takes at rest the position shown in the drawing. Valve 56 is provided with two pneumatic actuators which normally are pressurized. The valve body thereof can therefore take either position. In order to shift the valve 56 one of the actuators is vented. The control device 40 further comprises a shuttle valve 54 and two variable restriction valves 51, 55. The purpose of these valves is to restrict the flow in one direction and allow full flow in the other direction.

The purpose of the variable restriction valve 55 is to delay the pressurization of the left hand actuator of valve 56 when the control device 40 is connected to the pressure gas source 45. At this moment compressed gas is supplied via the conduit 42, the trigger valve 11 and the conduit 41 to the right hand actuator of valve 56. Furthermore, compressed gas is supplied via the valve 53, the shuttle valve 54 and the variable restriction valve 55 to the left hand actuator of valve 56. Because of the time delay, valve 56 is prevented from shifting to its right hand position. Such a shifting could cause unwanted spraying. When the control device is connected to the pressure gas source 45, chamber 36 is pressurized via the conduit 42 and the chambers 35 and 37 via valve 56 and the conduit 43.

In order to prevent unwanted spraying the gun is provided with a safety valve 60 which in the drawing is shown in the position it takes when the gun is ready for spraying. Valve 60 can be shifted by means of the actuator 61. Shifting valve 60 means that communication is established between the conduits 41 and 42. As a consequence, the right hand actuator of valve 56 is continously pressurized so that the gun cannot be used.

The device is in the drawing shown ready for spraying. It works in the following way.

The front piece is introduced into the cavity to be treated until the positioning collar 22 rests against the outer surface of the spray object. Then the trigger valve 11 is actuated so that it shifts to its right hand position. As a consequence conduit 41 and thus the right hand actuator of valve 56 are vented. Valve 56 is shifted to its right hand position by the pressure on its left hand actuator. Compressed gas is then supplied to the actuator of valve 53 via valves 56 and 52. Valve 53 is shifted to its right hand position. Compressed gas is then supplied to the upper side of piston 7 of cylinder 2 via valve 53 and the variable restriction valve 51. Furthermore, compressed gas is supplied to the left hand actuator of valve 56 via valve 53, the shuttle valve 54 and the variable restriction valve 55 so that valve 56 is held in its right hand position independent of the pressure in conduit 41. When valve 56 has been shifted to its right hand position the lower side of piston 7 of cylinder 2 and conduit 43 and thus chambers 35 and 37 are vented. As a consequence, the spray material valve 30 is opened. Furthermore, piston 7 is pressed downwards by the pressure on its upper side so that the pump 1 delivers spray material to the front piece 20 via conduit 14 and the spray material valve 30. Furthermore, compressed gas is supplied via valve 56 and the inlet nipple 17 to the spray material for further atomization thereof. The spray material thus atomized is injected into the cavity to be treated.

By means of the restriction of the variable restriction valve 51, which is adjusted by means of adjusting means 50, the gas flow to the upper side of piston 7 can be restricted more or less. As a consequence, the speed of the pump stroke can be adjusted so that the spray material is fed to the gun at the desired rate. Since compressed gas is fed via the nipple 17 independent of the restriction of the variable restriction valve 51, the relation between the amounts of compressed gas and spray material supplied to the front piece 20 can be changed. As a consequence, the further atomization of the spray material and thus its depth of penetration into the cavity can be changed. To be able to coat particularly difficult cavities from a minimum number of injection holes the device can be made such that the adjustment of the restriction of the variable restriction valve 51 is controlled by the movement of the piston rod 3, e.g. by means of a cam 65 connected to the piston rod 3. The cam follower 66 then actuates the adjusting means 50 of the restriction via a suitable motion transferring device 67. As a consequence, the further advantage is obtained that the depth of penetration of the spray material into the cavity can be changed during the spray cycle.

Since valve 56 because of the pressurization of its left hand acutator via valves 53, 54 and 55 is held in its right hand position independent of the pressure in conduit 41, spraying is continued even if the trigger valve 11 is shifted to its left hand position. The amount of injected material is thus completely controlled by the control device 40.

When the flange 6 on the piston rod 3 shifts valve 52 to its right hand position, the actuator of valve 53 is vented so that valve 53 is shifted to its left hand position. As a consequence, the upper side of piston 7 of cylinder 2 is vented via the variable restriction valve 51 and valve 53. As a consequence, the pump stroke is interrupted. Furthermore, the left hand actuator of valve 56 is vented via the variable restriction valve 55, the shuttle valve 54 and either valve 53 or valve 56. If valve 11 still is in its right hand position, admission of compressed gas through the nipple 17 will continue until valve 11 is shifted. If valve 11 has been returned to its left hand position, the right hand actuator of valve 56 is pressurized via conduit 42, valve 11 and conduit 41. Valve 56 is then shifted to its left hand position. As a consequence, compressed gas supply to the nipple 17 is interrupted. Furthermore, conduit 43 and thus chambers 35 and 37 are pressurized so that the spray material valve 30 is closed. Furthermore, the lower side of piston 7 of cylinder 2 is pressurized so that piston rod 3 returns to its upper position sucking further spray material into the pump 1. Furthermore, the left hand actuator of valve 56 is pressurized via valve 56, shuttle valve 54 and the variable restriction valve 55. The device is now ready for the next spraying cycle.

The above described and in the drawing shown embodiment is only to be regarded as an example which may be modified within the scope of subsequent claims. The positioning collar 22 may, for example, be eliminated in certain applications.

What I claim is:

1. A spray device for internal coating of hollow spray objects comprising:

a spray gun including a spray material valve (30), a servomotor (12) controlling the spray material valve, and a trigger means (11) for controlling the servomotor, a piston pump (1) for feeding spray material to the spray gun, the spray gun further including a connection (17) for controlled admission of pressure gas for atomization of the spray material, and a control device (40) coupled to the spray gun for controlling the ejection of spray material from the spray gun, said control device (40) comprising adjusting means (5) for controlling the length of the stroke of said piston pump (1) to adjust the relation between the amounts of pressure gas and spray material supplied to the spray gun, thereby controlling the degree of atomization of the spray material emitted from the spray gun.

2. A spray device according to claim 1, wherein said adjusting means (51) comprises a variable restriction by means of which the speed of the stroke of piston pump (1) can be changed.

3. A spray device according to claim 2, wherein said variable restriction includes an adjustment means (50) for adjusting the restriction.

4. A spray device according to claim 3, wherein said piston pump (1) has a piston rod (3), and wherein said control device (40) includes means (65, 66, 67) connected to said piston rod (3) of said pump (1) and to said adjustment means (50) of said variable restriction for adjustment of said restriction in dependence of the movement of said piston rod.

5. A spray device according to claim 1, wherein said spray gun includes an atomizing nozzle (13), and wherein said pressure gas for atomization of the spray material is admitted downstream of said atomizing nozzle.

6. A spray device according to claim 1, wherein said control device further comprises means for controlling the admission of said pressure gas for atomization of the spray material into said connection (17).

* * * * *

UNITED STATES PATENT AND TRADEMARK OFFICE

CERTIFICATE OF CORRECTION

PATENT NO. : 4,197,994

DATED : April 15, 1980

INVENTOR(S) : Kurt H. LIEDBERG

It is certified that error appears in the above-identified patent and that said Letters Patent are hereby corrected as shown below:

Column 4, line 40 (claim 1), change "(5)" to --(51)--.

Signed and Sealed this

*Fifteenth* Day of *July 1980*

[SEAL]

*Attest:*

SIDNEY A. DIAMOND

*Attesting Officer*

*Commissioner of Patents and Trademarks*